United States Patent [19]

Long

[11] 4,046,124

[45] * Sept. 6, 1977

[54] HIGH PERFORMANCE IGNITION CIRCUIT

[76] Inventor: Leslie T. Long, 9016 A Canal St., Orange, Calif. 92665

[ * ] Notice: The portion of the term of this patent subsequent to Sept. 30, 1992, has been disclaimed.

[21] Appl. No.: 612,200

[22] Filed: Sept. 10, 1975

[51] Int. Cl.[2] ..... F02D 1/00

[52] U.S. Cl. ..... 123/148 E; 315/209 T

[58] Field of Search ..... 123/117 R, 146.5 A, 123/148 E, 148 CC; 315/209 T

[56] References Cited

U.S. PATENT DOCUMENTS

| | | | |
|---|---|---|---|
| 3,060,346 | 10/1962 | Sohner | 123/148 E |
| 3,087,090 | 4/1963 | Konopa | 123/148 E |
| 3,357,416 | 12/1967 | Huntzinger | 315/209 T |
| 3,422,804 | 1/1969 | Van Mastrigt | 123/148 E |
| 3,473,061 | 10/1969 | Soehner | 123/148 E |
| 3,749,974 | 7/1973 | Kissel | 123/148 E |
| 3,881,458 | 5/1975 | Roozenbeck et al. | 123/148 E |
| 3,908,622 | 9/1975 | Long | 315/209 T |

*Primary Examiner*—Carroll B. Dority, Jr.
*Assistant Examiner*—Paul Devinsky
*Attorney, Agent, or Firm*—Fulwider, Patton, Rieber, Lee & Utecht

[57] ABSTRACT

There is disclosed an ignition system for a multicylinder internal combustion engine which employs a conventional Kettering ignition coil and a pulse generator such as an induced voltage coil operating in cooperation with a magnetic circuit driven in timed relationship to the engine for generating a train of voltage pulses in synchronism wih the engine. The circuit of the invention includes a circuit across a source of electrical energy and the primary windings of the ignition coil with an electronic switch therein and with a high frequency pass filter in circuit between the induction coil and the electronic switch of the primary windings circuit to pass only the high frequency voltage pulses that are responsive to the inflection point of the cyclic voltage induced in the induction coil. The high pass filter is preferably a tuned RC circuit operative to effect pulse shaping of the train of induced voltage pulses to a train of sharp peak voltage pulses of minimal time and duration. The train of shaped voltage pulses is applied to bias the electronic switch of the primary coil windings momentarily into nonconduction, thereby achieving extremely rapid collapse of the ignition coil magnetic field and generating maximum high voltage pulses in the ignition coil secondary windings throughout engine speeds up to 10,000 revolutions per minute and greater.

6 Claims, 10 Drawing Figures

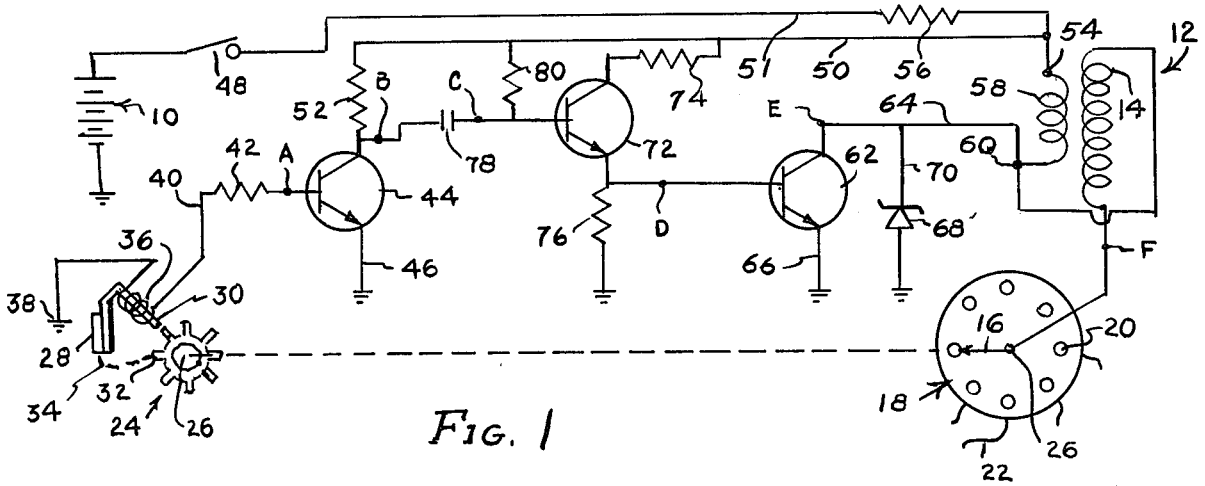
FIG. 1
FIG. 2a
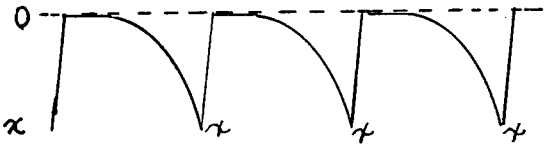
FIG 2b
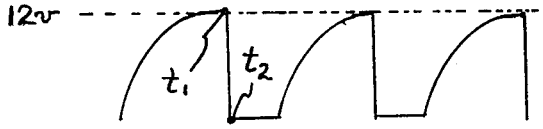
FIG. 2c
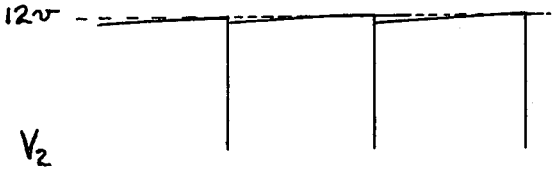
FIG. 2d
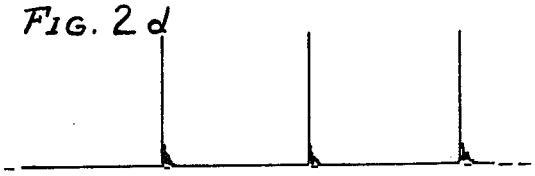
FIG. 2e
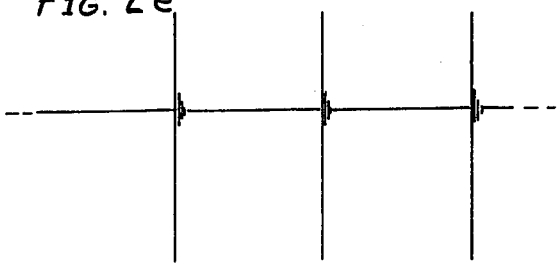
FIG. 3a
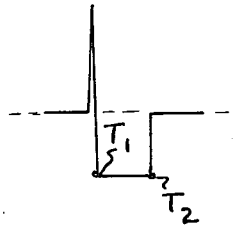
FIG. 4a
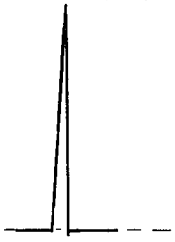
FIG. 3b
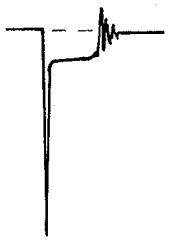
FIG. 4b
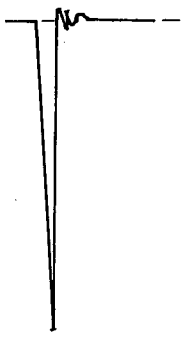

HIGH PERFORMANCE IGNITION CIRCUIT

BACKGROUND OF THE INVENTION

1. Field of the Invention

This invention relates to ignition circuits and, in particular, to a high performance ignition circuit having minimal components and maximum performance characteristics and life.

2. Description of the Prior Art

The conventional automative ignition circuits are based on the Kettering circuit which employs make-and-break contacts mechanically actuated by a cam on a distributor shaft which is driven by the engine. These contacts are in the primary winding circuit of the ignition coil to interrupt the circuit through the primary windings, collapsing the magnetic field of the coil and inducing high voltage pulses in the secondary windings. This circuit is subject to the mechanical shortcomings of the make-and-break contacts which limit its acceleration and top engine speed characteristics. Additionally, the maximum voltage induced in the secondary windings is often less than the optimum voltage for efficient engine firing.

The shortcomings of the conventional make-and-break contacts of automotive ignition systems have led to development of various solid state ignition systems including capacitor discharge systems in which a capacitor is charged, often in a regenerative manner, by a circuit which uses the timing pulses of the conventional make-and-break contacts and which uses a switching device such as a silicon controlled rectifier to discharge the capacitor through the primary windings of the ignition coil. These units have been employed successfully to increase the high voltage output from an ignition coil and to increase the limiting engine speed above the attained with conventional ignition systems. Capacitive discharge systems, however, have been subject to failure of critical circuit components and are relatively expensive to install and maintain and require alterations in the ignition coil connections which prohibit use of conventional engine instruments such as tachometers and ignition scopes without the use of auxiliary or accessory equipment.

There presently exists an unsatisfied demand for a reliable and relatively inexpensive ignition system having high performance characteristics, typically capable of producing from 20 to about 30 kilovolt ignition pulses in the secondary windings and engine speeds of 10,000 rpm. or greater. Desirably, such an ignition circuit should be useful with the conventional automotive ignition coil which has a ratio of secondary to primary turn windings of about 100/1. Desirably, such an ignition circuit should also be useful without any alterations in the ignition coil terminal connections, thereby permitting use of conventional engine instruments and, most preferably, useful in combination with a magnetic pulse generator, thereby freeing the ignition circuit from the mechanical shortcomings of the conventional make-and-break contacts.

BRIEF STATEMENT OF THE INVENTION

This invention comprises an ignition circuit which can be directly connected in a standard ignition system utilizing the existing connections of the standard ignition coil and capable of generating a train of ignition pulses comparable to that of a capacitive discharge system without the use of costly and troublesome circuit components such as large, high voltage capacitors and silicon control rectifiers. The ignition circuit of this invention is employed in an otherwise conventional ignition system for a multicylinder internal combustion engine having a source of electrical energy with a coil having primary and secondary windings and a primary circuit from the source of electrical energy through said primary windings and switching means it circuit therewith to interrupt the circuit and generate the train of high voltage pulses in the secondary windings.

Preferably, the circuit also includes inductive coil means for magnetically producing a train of voltage pulses in time with the rotation of the engine. The circuit of the invention includes high frequency pass filter means in circuit between the inductive coil means and the switching means of the primary winding circuit to pass only a high frequency voltage pulse that is responsive to the inflection point of the cyclic voltage induced in the inductive coil. The filter means is preferably an RC circuit that is tuned to effect voltage pulse shaping from the low frequency cyclic induced voltage of the pickup coil to a train of very high frequency voltage pulses having peak voltages many times greater than the maximum voltage of the train of voltage pulses generated in the inductive coil circuit.

The high frequency voltage pulses passed through the filter means are applied to bias a switching transistor in the ignition circuit momentarily off, causing an extremely rapid collapse of the magnetic field in the ignition coil and insuring generation of sparking voltages in the secondary windings of maximum intensity. The ignition circuit is ideally suited for high engine speeds since the duration of the open circuit through the primary windings is maintained at a minimal value, thereby insuring maximum dwell time for acheiving current saturation in the primary windings of the ignition coil.

BRIEF DESCRIPTION OF THE DRAWINGS

The invention will be described with reference to the figures of which:

FIG. 1 is a schematic of the ignition circuits of the invention;

FIG. 2*a* through *e* illustrate the voltage wave forms at various locations of the ignition circuit;

FIG. 3*a* and *b* illustrate the voltage wave forms of a conventional ignition system; and FIGS. 4*a* and *b* illustrate the voltage wave forms of a typical capacitive discharge ignition system.

DESCRIPTION OF PREFERRED EMBODIMENTS

Referring to FIG. 1, there is disclosed an ignition circuit for use with an automotive engine which includes a source of electrical energy such as a conventional storage battery 10 with an ignition coil 12 having a secondary winding 14 in circuit with the rotor 16 of a conventional distributor 18. The rotor directs the high voltage discharge from secondary windings 14 of coil 12 to one of a plurality of peripherally disposed contact posts 20 which are connected to conventional ignition wiring 22 leading to the spark plugs of the engine.

The distributor also commonly supports a pulse generator 24 which is usually on a common shaft 26 with rotor 16. In the illustrated embodiment, generator 24 comprises a magnetic pulse generator formed of permanent magnet 28, pole piece 30 and a magnetic pulse wheel 32 having a plurality of radial ribs which are rotated past the end of pole piece 30 in synchronism with the engine, establishing a magnetic circuit through the distributor and returning to the magnet through the broken line path 34. The voltage pulse generator also includes an induction coil 36 which extends about pole piece 30 so that the change in magnetic flux through the magnetic circuit caused by rotation of pulse wheel 32 induces a train of cyclic voltage pulses in coil 36.

The circuit of this invention is particularly suited for high speed operation and can also be used with a crankshaft voltage pulse generator such as that used on modified dampeners of racing engines. In this application, the magnet 28 and pole piece 30 are mounted on the engine with pole piece 30 directed towards the dampener centerline. A plurality of ferromagnetic elements such as steel machine bolts are secured in threaded bores in the dampener, corresponding to the radial ribs of pulse wheel 32. This application functions electronically the same as that shown in FIG. 1 and is free from timing errors caused by gear lash and cam shaft torsional strain which can be present at high speed operation of the FIG. 1 system.

In both applications, one terminal of coil 36 is grounded at 38 while the opposite terminal is connected through lead 40 to resistor 42 extending to the base terminal of transistor 44 which is in grounded emitter configuration through ground lead 46. The positive terminal of battery 10 is connected by lead 51 through ignition switch 48 and conventional ignition resistor 56 to the positive terminal 54 of the ignition coil and the plus buss 50 of the ignition circuit is also connected to terminal 54. Resistor 52 is connected between the positive buss 50 and the collector terminal of transistor 44.

The negative terminal 60 of the primary winding of the coil is connected to the collector terminal of switching transistor 62 through lead 64. The emitter of switching transistor 62 is in grounded configuration through lead 66. Zener diode 68 is connected from lead 64 to ground through lead 70 and is connected to conduct reverse voltage surges induced in primary windings 58 to ground, thereby protecting transistor 62 against spurious and reverse induced voltages. This Zener diode offers high voltage cut off protection for transistor 62.

The invention includes a pulse shaping circuit between the output of the inductive coil circuit, collector of transistor 44 and the input to the switching circuit of the primary coil, i.e., the base of transistor 62.

The transistor 62 of the switching circuit is connected in base-emitter configuration with a driver transistor 72 which is connected in a voltage divider former by resistor 74 and 76 connecting its collector and emitter terminals, respectively, to the positive buss 50 and to ground.

The pulse shaping of the ignition circuit is achieved by the RC network of capacitor 78 and resistors 52 and 80 which are sized with values that, together with the impedances of transistors 44 and 72 and the values of resistors 74 and 76, provide a tuned network circuit which is effective in blocking all voltage pulses from the base of transistor 72 except for the very high frequency voltage pulse which occurs at the maximum inflection point of each induced voltage pulse of the train of voltage pulses generated in the inductive circuit of the invention.

In the operation of the ignition circuit thus described, the closing of the ignition key 48 results in current flow through primary winding 58 of the ignition coil and the normally conducting NPN transistor 62. The magnitude of this current flow is limited by the conventional ignition resistor 54 and the impedance of transistor 62 which is selected to be compatible with the conventional ignition resistor 54 and ignition coil 12. The current flow through the voltage divider of resistor 74, normally conducting NPN transistor 72 and resistor 76 is sufficient to provide the necessary base voltage to transistor 62 to maintain this transistor in a saturated, conducting mode. As the engine is started and the magnetic flux through the magnetic circuit of the pulse generator 24 is changed in cyclic manner, a train of voltage pulses, generated in induction coil 36, is applied to the base of transistor 44, point A. The voltage pulses have the general configuration illustrated in FIG. 2*a* with a slowly increasingly negative voltage as a rib of pulse wheel 32 approaches the pole piece 30 and then a very sharp reversal at inflection points $x$ as the rib passes the pole piece. The induced voltage of coil 36 is applied, through resistor 42, to the base of NPN transistor 44 which is normally nonconducting. The induced voltage biases the base of transistor 44 sufficiently to drive the transistor into a conducting mode and the resultant current flow and voltage drop through resistor 52 causes, at point B, a slowly rising voltage at the collector of transistor 44 that increases to the battery voltage, e.g., 12 volts, until the instantaneous time, $t_1$, and then sharply decreases with the waveform shown in FIG. 2*b.*

The filter network is tuned to provide a high frequency band pass that will pass the high frequency voltage change from times $t_1$ to $t_2$ and apply this series of voltage changes as a train of voltage pulses to the base of driver transistor 72. The high frequency pulse occurs in a time period of the range of a few microseconds to milliseconds. This train of voltage pulses is shown in FIG. 2*c* which illustrates the wave form of the voltage at point C which is applied to the base of the transistor 72.

Transistor 72 is biased into a normally conducting mode by resistor 80 and provides impedance matching in the circuit for switching transistor 62. Accordingly, the waveform at point D is essentially the same configuration as that at point C.

The application of the train of high frequency voltage pulses $V_2$ to the base of switching transistor, however, results in instantaneously pulsing the transistor into a nonconducting mode for the duration of the extremely narrow voltage pulse, from times $t_1$ to $t_2$. The interruption of current flow through the primary winding 58 and resultant collapse of the electromagnetic field in coil 12 generates the voltage waveform shown in FIG. 2*d* at point E at maximum voltages of, typically, about 300 volts. More important however, the extremely rapid collapse of the magnetic field in coil 12 induces an extremely sharp voltage rise in secondary winding 14 having a maximum voltage of about 35 kilovolts with a conventional coil with a secondary to primary windings ratio of about 100/1. A reverse voltage of about 15 kilovolts is also generated and FIG. 2*e* shows the complete waveform of the secondary voltages at point F.

The wave forms of the ignition circuit of the invention can be compared to those of a standard ignition system, shown in FIGS. 3*a* and 3*b* and to those of a typical capacitive discharge ignition system shown in FIGS. 4*a* and 4*b.* As shown in FIG. 3*a,* the conventional point system interrupts the current flow through the primary winding, generating a voltage pulse upon collapse of the magnetic field. The contacts remain open through the time period $T_1$ to $T_2$. The resultant voltage induced in the secondary winding is shown in FIG. 3*b*. The value of the induced voltage in the secondary windings of a conventional ignition coil having a ratio of turns of secondary to primary windings of about 100/1 is from 20 to about 30 kilovolts provided that the primary windings have reached current saturation during the dwell portion of the ignition circuit, i.e., provided that the engine speed is not sufficient to provide inadequate dwell time for achieving current saturation of the primary windings.

FIGS. 4*a* and 4*b* illustrate the corresponding voltage wave forms of a typical capacitive discharge ignition system. These wave forms are derived, respectively, at the primary and secondary terminals of the ignition coil. The primary terminals of the ignition coil are, however, reversed from the conventional system and that of this invention. The wave form at the primary terminals shown in FIG. 4*a* comprises a very sharp spike characterized by a rapid voltage rise and a short time duration and the corresponding spark voltage developed in the secondary winding is of much shorter duration, typically about 1/10 the duration of a conventional ignition system. The magnitude of the voltage developed in the secondary is, however, substantially greater, typically from 30 to about 40 kilovolts.

The ignition system of this invention is comparable in voltage rise, spark time and voltage intensity with that of a typical capacitive discharge system. Typically, the spark duration is from 2 to about 5 times that of a capacitive discharge system and about 1/5 that of a conventional ignition system. Similarly, the intensity of the voltage in the secondary is from 25 to about 40 kilovolts, comparable to that of a typical capacitive discharge system. The ignition circuit of this invention thus provides ignition characteristics of a capacitive discharge circuit without the use of expensive or failure prone elements such as silicon controlled rectifiers or large high voltage capacitors. The circuit employs a minimal number of components and can be used with conventional or stock ignition elements such as the ignition resistor and coil. Since the circuit is not connected in reverse polarity to the coil, standard ignition test instruments can be used for inspection and service.

The invention has been described with reference to the present preferred and illustrated embodiments thereof. It is not intended that the invention be unduly limited by the description of the presently preferred embodiment. Instead, it is intended that the invention be defined by the means and their obvious equivalents set forth in the following claims.

What is claimed is:

1. In an ignition system for a multicylinder internal combustion engine having a source of electrical energy, a coil comprising primary and secondary windings, circuit means across said source and in series with said primary windings and including normally conducting switching transistor means, the improvement comprising:

a. voltage pulse generating means having a characteristic induced voltage pulse with a sharp voltage reversal inflection point;

b. high frequency pass RC filter means in circuit between said inductive coil means and the base of said switching means to pass only a high frequency voltage pulse responsive to the voltage reversal inflection point of the cyclic voltage induced in said inductive coil means; and c. means including a driver transistor in emitter-base connection between said switching transistor and said filter means to apply said high frequency voltage pulse to bias said switching means and momentarily open said circuit means of said primary windings for the time duration of the high frequency voltage pulse, corresponding to the time duration of said inflection of cyclic voltage in said inductive coil means.

2. The ignition system of claim 1 including a pulse train generating circuit having a normally off first transistor with said inductive coil means in circuit between the base and emitter of said first transistor to bias said first transistor in conduction.

3. The ignition system of claim 1 wherein said first, switching and driver transistors are connected with collector and emitter terminals across the source of electrical energy.

4. The ignition system of claim 1 including voltage divider means across said source in circuit with said driver transistor.

5. The ignition system of claim 1 wherein said RC circuit includes resistance means between said source and collector of said first transistor and second resistance means between said source and base of said driver transistor.

6. The ignition system of claim 1 including Zener diode means in circuit between said primary winding and ground to conduct reverse voltages generated in said ignition coil.

* * * * *